US009620900B2

(12) United States Patent
Yanase et al.

(10) Patent No.: US 9,620,900 B2
(45) Date of Patent: Apr. 11, 2017

(54) COAXIAL CONNECTOR WITH FLOATING MECHANISM

(71) Applicant: SMK Corporation, Tokyo (JP)

(72) Inventors: Tomoyasu Yanase, Tokyo (JP); Kiyoshi Asai, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/081,950

(22) Filed: Mar. 28, 2016

(65) Prior Publication Data

US 2016/0211614 A1 Jul. 21, 2016

Related U.S. Application Data

(63) Continuation of application No. PCT/JP2015/067373, filed on Jun. 10, 2015.

(30) Foreign Application Priority Data

Sep. 16, 2014 (JP) ..... 2014-187244

(51) Int. Cl.

| | |
|---|---|
| ***H01R 13/631*** | (2006.01) |
| ***H01R 24/44*** | (2011.01) |
| *H01R 13/6473* | (2011.01) |
| *H01R 103/00* | (2006.01) |

(52) U.S. Cl.

CPC ..... *H01R 13/6315* (2013.01); *H01R 24/44* (2013.01); *H01R 13/6473* (2013.01); *H01R 2103/00* (2013.01)

(58) Field of Classification Search

CPC ..... H01R 13/6315; H01R 24/50
USPC ..... 439/63
See application file for complete search history.

(56) References Cited

U.S. PATENT DOCUMENTS

| | | | | |
|---|---|---|---|---|
| 7,422,456 | B1 | 9/2008 | Mitani et al. | |
| 9,106,034 | B2 * | 8/2015 | Tsai | H01R 24/46 |
| 2006/0024985 | A1 | 2/2006 | Nagata et al. | |
| 2011/0312215 | A1 | 12/2011 | Uesaka et al. | |
| 2012/0108103 | A1 | 5/2012 | Ootani et al. | |
| 2015/0064975 | A1 | 3/2015 | Funayama et al. | |

FOREIGN PATENT DOCUMENTS

| | | |
|---|---|---|
| JP | 2007-109600 A | 4/2007 |
| JP | 2014-165084 A | 9/2014 |

OTHER PUBLICATIONS

International Search Report for International Application No. PCT/JP2015/067373, issued by the Japan Patent Office on Sep. 8, 2015.

* cited by examiner

*Primary Examiner* — Ross Gushi

(57) ABSTRACT

In a coaxial connector with a floating mechanism, a housing includes a housing base fixed to a support, a housing movable portion that is movable with a center contact relative to the housing base, and a floating spring one end of which is fixed to the housing base and the other end of which is fixed to the housing movable portion. The floating spring includes a support fixing portion fixed to the housing base, a floating fixing portion fixed to the housing movable portion, and an elastically deformable swing spring portion that couples the support fixing portion and the floating fixing portion.

8 Claims, 8 Drawing Sheets

COAXIAL CONNECTOR WITH FLOATING MECHANISM

CROSS REFERENCE TO RELATED APPLICATION

The contents of the following Japanese patent application and International patent application are incorporated herein by reference, Japanese Patent Application No. 2014-187244 filed on Sep. 16, 2014, and International Patent Application No. PCT/JP2015/67373 filed on Jun. 10, 2015.

FIELD

The present invention relates to a connector for making connection to a mating coaxial connector, and more specifically relates to a coaxial connector with a floating mechanism that is easily connected to a mating coaxial connector.

BACKGROUND

A coaxial connector of this type includes a center contact disposed at the center thereof and an outer contact disposed outside the center contact. When the coaxial connector is mutually fitted onto a mating coaxial connector, both of the center contact and the outer contact thereof are required to be appropriately connected to a center contact and an outer contact of the other coaxial connector, respectively.

Thus, even if a positional deviation occurs in an axial direction or a radial direction between the coaxial connectors to be connected to each other, owing to the attachment position of the coaxial connector relative to a support such as a mounting board installed in electronic equipment or a chassis, the positional deviation has to be corrected when connecting both the coaxial connectors.

Therefore, coaxial connectors with a floating mechanism are conventionally used that have a connector body shiftable in an axial radial direction relative to a connector base fixed on a support, so that the connector body is connected to another coaxial connector (for example, see Patent Literature 1).

In the coaxial connector with the floating mechanism, the connector body is provided with a center contact disposed at the center thereof, an outer contact disposed outside the center contact, and an insulator interposed between the center contact and the outer contact. The center contact and the outer contact are connected to a center contact and an outer contact of the mating coaxial connector, respectively.

On the other hand, the connector base is provided with a cylindrical outer shell for holding the connector body in a shiftable manner, a center conductor portion disposed at the center within the outer shell, an insulating member for insulating the center conductor portion from the outer shell, and biasing means such as a coil spring or a disc spring for biasing the connector body held by the outer shell in an axial direction or in a radial direction, so that the connector body can be mutually connected to the mating coaxial connector even if an axial deviation occurs.

CITATION LIST

Patent Literature

Patent Literature 1: Japanese Patent Application Laid-Open No. 2008-262736

SUMMARY

Technical Problem

However, the conventional technique described above has such a problem in which since the connector body to be mutually connected to the mating coaxial connector and the connector base for holding the connector body in a shiftable manner are separately provided, the entire coaxial connector becomes large in outer size, thus interfering with miniaturization.

Also, the conventional coaxial connector with the floating mechanism requires the coil spring or the disc spring for biasing the connector body in the axial direction or the radial direction, and hence there arises a problem in which the number of components as well as a product cost and a manufacturing process increase.

Furthermore, in this type of conventional coaxial connector with the floating mechanism, the center contact of the connector body and the center conductor of the connector base are separately formed, and the connector body is made shiftable relative to the connector base in the axial direction or the radial direction. Thus, this conventional coaxial connector with the floating mechanism requires a structure to shift and electrically connect the center contact and the center conductor to each other. Thus, there arises a problem in which the structure is complicated.

Moreover, although high-frequency performance is important for this type of coaxial connector, an axial deviation between the center contact and the center conductor of the connector base, caused by a shift of the center contact together with the connector body, may bring about deterioration in the high-frequency performance.

Considering such conventional problems, an object of the present invention is to provide a coaxial connector with a floating mechanism that has a less number of components and can be miniaturized, with ensuring good high-frequency performance and floating performance.

Solution to Problem

To solve the conventional problems described above and achieve the object, the invention according to a first aspect is a coaxial connector with a floating mechanism. The coaxial connector includes a center contact to be mutually connected to a mating center contact, an outer contact disposed outside the center contact, and a housing for keeping the center contact and the outer contact insulated from each other. The housing includes a housing base fixed to a support, a housing movable portion that is movable together with the center contact relative to the housing base, and a floating spring one end of which is fixed to the housing base and the other end of which is fixed to the housing movable portion. The floating spring includes a support fixing portion fixed to the housing base, a floating fixing portion fixed to the housing movable portion, and an elastically deformable swing spring portion for coupling the support fixing portion and the floating fixing portion. The housing movable portion is supported by the housing base through the floating spring in a movable manner.

The invention according to a second aspect is configured such that, in addition to the structure of the first aspect, the swing spring portion integrally includes an elastically expandable and contractible portion that is expandable and contractible in a direction between the support fixing portion and the floating fixing portion, and an elastically twistable portion that is twistable about an axis in the direction between the support fixing portion and the floating fixing portion.

The invention according to a third aspect is configured such that, in addition to the structure of the first or second aspect, the center contact includes a contact portion that moves together with the housing movable portion, and a circuit board connection terminal to be connected to a mounting board. The contact portion is integrally supported by the floating fixing portion. The circuit board connection terminal is integrally supported by a support portion. The center contact and the floating spring are integrated into one unit.

The invention according to a fourth aspect is configured such that, in addition to the structure of the third aspect, the floating spring includes, at the swing spring portion, an impedance adjusting portion a width of a plate of which is changeable. The width of the impedance adjusting portion is appropriately changed such that the center contact has an appropriate impedance.

The invention according to a fifth aspect is configured such that, in addition to the structure of any of the first to fourth aspects, the outer contact includes, outside the housing movable portion, a pair of elastic contact pieces that are opposite to each other with a gap in a direction orthogonal to the direction between the support fixing portion and the floating fixing portion.

The invention according to a sixed aspect is configured such that, in addition to the structure of any of the first to fifth aspects, a plurality of housing movable portions are supported in a movable manner by the housing base.

The coaxial connector with the floating mechanism according to an aspect of the present invention, as described above, includes the center contact to be mutually connected to the other center contact, the outer contact disposed outside the center contact, and the housing for keeping the center contact and the outer contact insulated from each other. The housing includes the housing base fixed to the support, the housing movable portion that is movable together with the center contact relative to the housing base, and the floating spring one end of which is fixed to the housing base and the other end of which is fixed to the housing movable portion. The floating spring includes the support fixing portion fixed to the housing base, the floating fixing portion fixed to the housing movable portion, and the elastically deformable swing spring portion for coupling the support fixing portion and the floating fixing portion. Furthermore, the housing movable portion is supported by the housing base through the floating spring in a movable manner. With this configuration, it is possible to integrate a portion having a mutual connection to the mating coaxial connector with a portion constituting the floating mechanism, thus making the connector small in size and reducing the number of components.

Also, according to an aspect of the present invention, the swing spring portion integrally includes the elastically expandable and contractible portion that is expandable and contractible in the direction between the support fixing portion and the floating fixing portion, and the elastically twistable portion that is twistable about an axis in the direction between the support fixing portion and the floating fixing portion. With this configuration, it is possible to provide a simple structure that smoothly allows a movement in any of front-back and lateral directions.

Furthermore, according to an aspect of the present invention, the center contact includes the contact portion that moves together with the housing movable portion, and the circuit board connection terminal to be connected to the mounting board. The contact portion is integrally supported by the floating fixing portion, the circuit board connection terminal is integrally supported by the support portion, and the center contact and the floating spring are integrated into one unit. With this configuration, it is possible to reduce the number of components and simplify an assembly process. Also, since the center contact follows movements of the housing movable portion, it is possible to prevent a deviation of a central axis in the connector and thus prevent a deterioration in high-frequency performance.

Furthermore, in an aspect of the present invention, the floating spring includes, at the swing spring portion, the impedance adjusting portion the width of the plate of which is changeable. The width of the impedance adjusting portion is appropriately changed such that the center contact has an appropriate impedance. With this configuration, the high-frequency performance and the impedance can be adjusted without requiring a significant change of a product size, a press die, and the like.

Also, in an aspect of the present invention, the outer contact includes, outside the housing movable portion, the pair of elastic contact pieces that are opposite to each other with the gap in the direction orthogonal to the direction between the support fixing portion and the floating fixing portion. With this configuration, the outer contact allows movements of the housing movable portion and the center contact in the direction between both the elastic contact pieces, and facilitates a reliable connection to another outer contact.

Furthermore, an aspect of the present invention can be applied to a multiple connected coaxial connector, by supporting the plurality of housing movable portions in a movable manner by the housing base.

DESCRIPTION OF EMBODIMENTS

Next, an aspect of the present invention will be described with reference to an embodiment shown in FIGS. 1A to 8B. In this embodiment, a coaxial connector 1 with a floating mechanism is applied to a socket, and a mating coaxial connector 2 is applied to a plug.

Figure 1A:
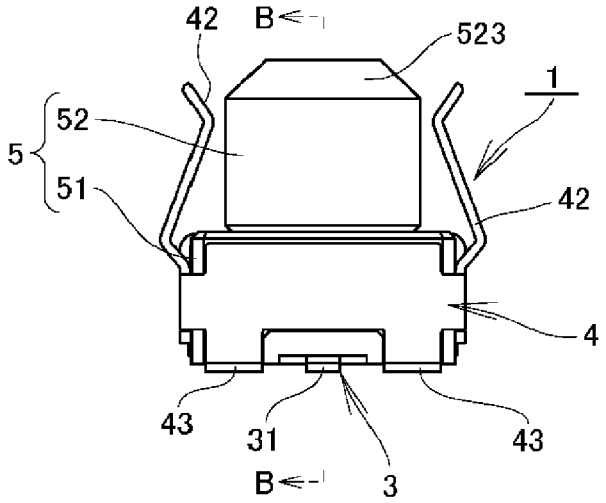
FIG. 1A is a front view showing an example of a coaxial connector with a floating mechanism according to the present invention.
Figure 1B:
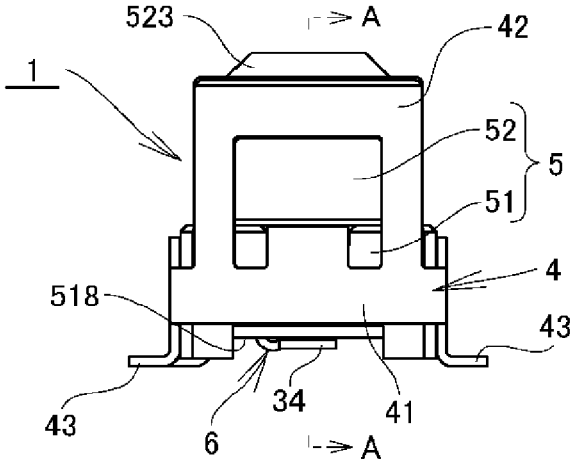
FIG. 1B is a side view of the same.
Figure 1C:
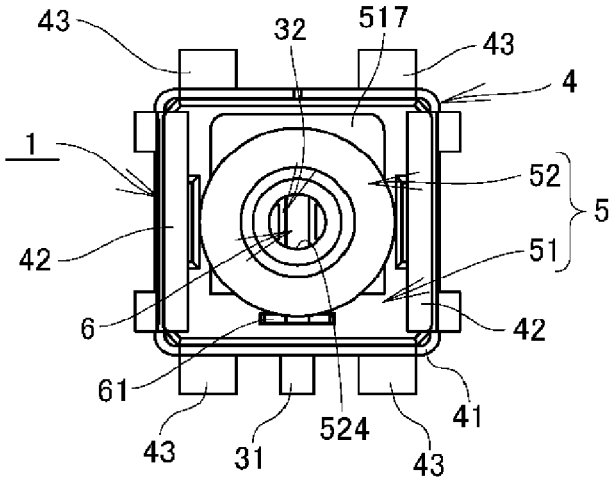
FIG. 1C is a plan view of the same.
Figure 2A:
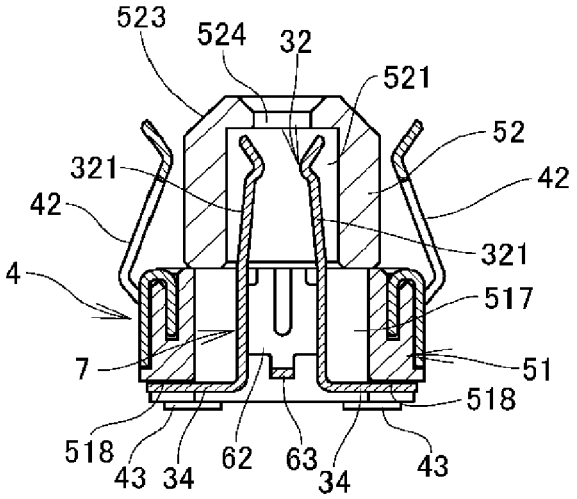
FIG. 2A is a cross-sectional view taken along line A-A in FIG. 1B.
Figure 2B:
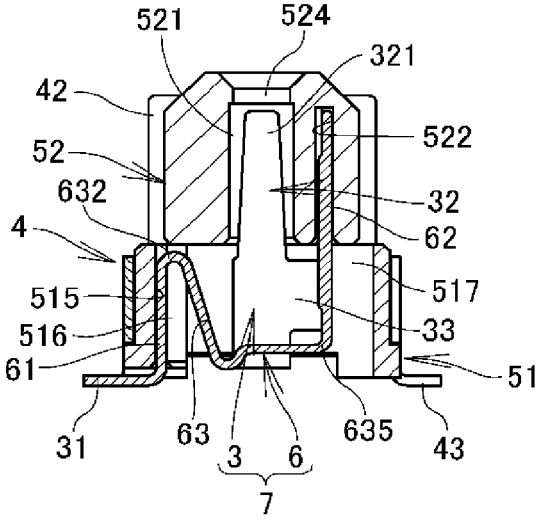
FIG. 2B is a cross-sectional view taken along line B-B in FIG. 1A.
Figure 3A:
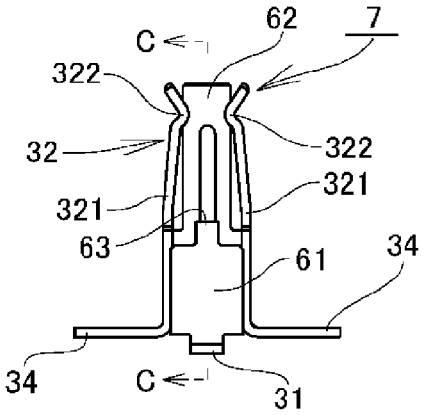
FIG. 3A is a front view of a floating spring used in the above-described coaxial connector with the floating mechanism.
Figure 3B:
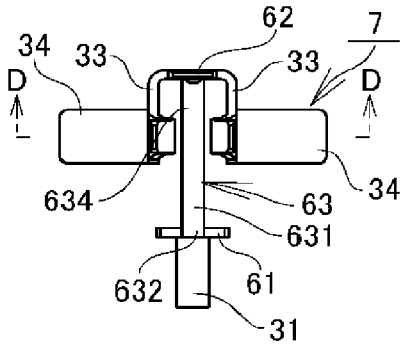
FIG. 3B is a plane view of the same.
Figure 3C:
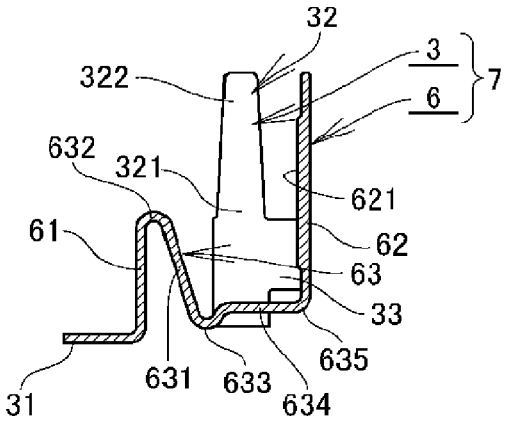
FIG. 3C is a cross-sectional view taken along line C-C in FIG. 3A.
Figure 3D:
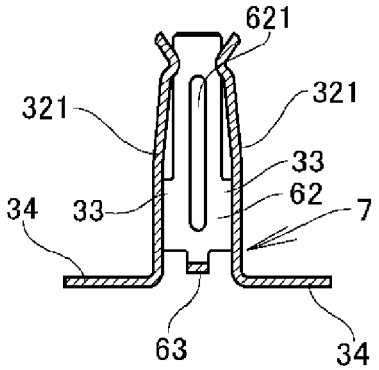
FIG. 3D is a cross-sectional view taken along line D-D in FIG. 3B.

In this embodiment, a vertical direction refers to the direction of connecting both the coaxial connectors in FIG. 1A. A top side refers to the connected side to the other connector, and a bottom side refers to the mounted side on a mounting board. Out of two directions orthogonal to the vertical direction, the width direction of the connector shown in FIG. 1A is referred to as a lateral direction. The other width direction, that is, the width direction of the connector shown in FIG. 1B is referred to as a front-back direction.

The coaxial connector 1 with the floating mechanism includes a center contact 3 disposed at the center thereof, an outer contact 4 disposed outside the center contact 3, and a housing 5 to keep the center contact 3 and the outer contact 4 insulated from each other. The coaxial connector 1 is mutually fitted onto the mating coaxial connector 2, so that the center contact 3 is connected to a mating center contact 21 and the outer contact 4 is connected to a mating outer contact 22.

In the coaxial connector 1 with the floating mechanism, the housing 5 includes a housing base 51 fixed to a support such as a mounting board or an electronic equipment case, a housing movable portion 52 that is disposed on the housing base 51 and movable together with the center contact 3 relative to the housing base 51, and a floating spring 6 the one end of which is fixed to the housing base 51 and the other end of which is fixed to the housing movable portion 52. The housing movable portion 52 is supported together with the center contact 3 in a movable manner by the housing base 51 through the floating spring 6, thereby forming the floating mechanism.

Furthermore, in this coaxial connector 1 with the floating mechanism, a contact-equipped floating spring (hereinafter called integral spring 7) made of a conductive metal plate, into which the center contact 3 and the floating spring 6 are integrated, is used so that the center contact 3 can follow movements of the housing movable portion 52.

As shown in FIGS. 3A to 3D, the integral spring 7 is formed into one unit by punching and bending the elastic conductive metal plate. The integral spring 7 has such a structure that the floating spring 6 integrally supports the center contact 3 and part of the center contact 3 doubles as the floating spring 6.

The floating spring 6 includes a support fixing portion 61 fixed to the housing base 51, a floating fixing portion 62 fixed to the housing movable portion 52, and an elastically deformable swing spring portion 63 that couples the support fixing portion 61 and the floating fixing portion 62. The support fixing portion 61 and the floating fixing portion 62 are disposed in the front-back direction in parallel with each other with leaving a gap. Owing to an elastic deformation of the swing spring portion 63, the floating fixing portion 62 can move back and forth and swing laterally with respect to the support fixing portion 61.

The support fixing portion 61 is formed in a rectangular shape. One end of the swing spring portion 63 is integrally supported by a top end of the support fixing portion 61. From a bottom end of the support fixing portion 61, a circuit board connection terminal piece 31, which constitutes the center contact 3, extends in a horizontal direction.

The swing spring portion 63 is integrally provided with an elastically expandable and contractible portion 631 that is expandable and contractible in a direction between the support fixing portion 61 and the floating fixing portion 62, that is, in the front-back direction, and elastically twistable portions that are twistable about an axis in the direction between the support fixing portion 61 and the floating fixing portion 62. The expansion or contraction of the elastically expandable and contractible portion 631 allows the floating fixing portion 62 to move in the front-back direction with respect to the support fixing portion 61. The twist of each of the elastically twistable portions allows the floating fixing portion 62 to move in the lateral direction with respect to the support fixing portion 61. Also, the swing spring portion 63 returns the floating fixing portion 62 to its original position by elasticity.

The elastically expandable and contractible portion 631 extends obliquely downward in such a state that a top end of the elastically expandable and contractible portion 631 is supported by the top end of the support fixing portion 61 through a bent portion 632 that is bent in an arc shape. A bottom end of the elastically expandable and contractible portion 631 integrally supports an impedance adjusting portion 634, which extends in the horizontal direction, through a bent portion 633.

The elastically expandable and contractible portion 631 can expand and contract in the direction between the support fixing portion 61 and the floating fixing portion 62, that is, in the front-back direction due to the bending of both the bent portions 632 and 633, and return to its original position by elasticity.

The impedance adjusting portion 634 is formed into the shape of a narrow plate extending in the horizontal direction. One end thereof is supported by the elastically expandable and contractible portion 631 through the bent portion 633, while the other end thereof is integrally supported by a bottom end of the floating fixing portion 62 through a bent portion 635.

The width of the plate of the impedance adjusting portion 634 is changeable in the lateral direction. By appropriately changing the width of the impedance adjusting portion 634, the impedance of the center contact 3, which is integrated with the floating spring 6, can be adjusted to an appropriate value.

The bent portions 632 and 635 are formed narrower than the widths of the support fixing portion 61 and the floating fixing portion 62, respectively, and constitute the elastically twistable portions of the swing spring portion 63.

Specifically, when the floating fixing portion 62 moves in the lateral direction relative to the support fixing portion 61, the bent portions 632 and 635 each twist about the axis in the direction between the support fixing portion 61 and the floating fixing portion 62, thereby allowing the movement in the lateral direction. In addition, the bent portions 632 and 635 can return to their original positions by elasticity.

The floating fixing portion 62 is formed in the shape of a rectangular extending in the vertical direction. The floating fixing portion 62 is integrally provided at its center with a longitudinal ridge-shaped expanded portion 621 expanding on the side of the support fixing portion 61. The floating fixing portion 62 integrally supports elastic catching pieces 321 and 321, which constitute a connecting portion 32 of the center contact 3, on both sides in a bottom end.

The center contact 3 includes the connecting portion 32 to be connected to the mating center contact 21, and the circuit board connection terminal piece 31 to be connected to the mounting board. The connecting portion 32 and the board connection terminal piece 31 are electrically connected through the floating spring 6.

The connecting portion 32 is provided with the pair of the elastic catching pieces 321 and 321 that are opposite to each other in the lateral direction. The connecting portion 32 is connected to the pin-like mating center contact 21 by catching the mating center contact 21 between both of the elastic catching pieces 321 and 321.

Each of the elastic catching pieces 321 and 321 is formed in the shape of a vertically long strip. A lower side edge of the elastic catching piece 321 is integrally supported by a support piece 33, which is orthogonally bend from a side edge of a bottom end of the floating fixing portion 62. The elastic catching pieces 321 are disposed opposite to each other in the lateral direction between the support fixing portion 61 and the floating fixing portion 62.

Each of the elastic catching pieces 321 and 321 is formed with a contact point 322 curved inward at its upper end. The mating center contact 21 is caught between the contact points 322 and 322 that are opposite to each other.

Each of the elastic catching pieces 321 and 321 integrally supports a retained guide piece 34 extending in an outward horizontal direction at its bottom end. The retained guide piece 34 abuts against and is retained by a bottom end of the housing base 51 in a movable manner in the front-back and lateral directions.

Figure 4A:
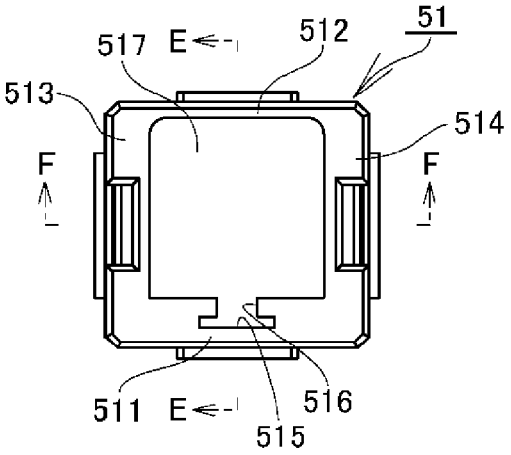
FIG. 4A is a plan view of a housing base shown in FIGS. 1A to 1C.
Figure 4B:
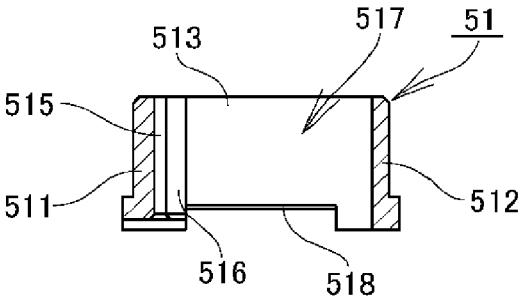
FIG. 4B is a cross-sectional view taken along line E-E in FIG. 4A.
Figure 4C:
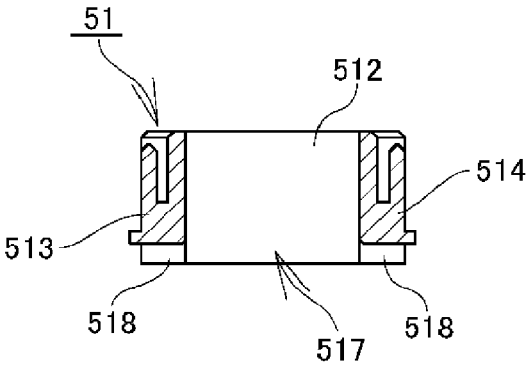
FIG. 4C is a cross-sectional view taken along line F-F in FIG. 4A.

As shown in FIGS. 4A to 4C, the housing base 51 is formed from an insulating synthetic resin into the shape of a prism that is open at its top and bottom and has front, back, left, and right side walls 511 to 514. The housing movable portion 52 is assembled from the top of the housing base 51, and the integral spring 7 is assembled from the bottom thereof. The housing movable portion 52 is joined to the housing base 51 through the floating spring 6 in a movable manner.

The front side wall 511 is formed with a support fixing portion press-fitted portion 515 extending in the vertical direction. By press-fitting the support fixing portion 61 of the floating spring 6 into the support fixing portion press-fitted portion 515, one end of the floating spring 6, that is, the support fixing portion 61 is fixed to the housing base 51.

The front side wall 511 is also formed with an avoidance groove 516 that is open on the side of an inner surface of the support fixing portion press-fitted portion 515 and is communicated with the support fixing portion press-fitted portion 515, in order to prevent interference of the swing spring portion 63 with the side wall 511.

Thus, the floating fixing portion 62 and both the elastic catching pieces 321 and 321 of the integral spring 7 are supported at their lower portions by the housing 5 through the swing spring portion 63 and also contained in an inner hollow portion 517 in a movable manner. Furthermore they protrude at their upper portions from a top opening of the inner hollow portion 517.

The left and right side walls 513 and 514 of the housing base 51 are each formed with a concave guide slot 518 at its lower surface. The retained guide pieces 34 of the integral spring 7 are inserted into the guide slots 518, so that the guide slots 518 guide the retained guide pieces 34. The retained guide pieces 34 then abut against the guide slots 518 at their upper edges to prevent the integral spring 7 from being pulled out.

To the housing base 51, the outer contact 4 made of a conductive metal material is assembled from the outside. The housing base 51 is fixed to the support such as the mounting board through the outer contact 4.

Figure 5A:
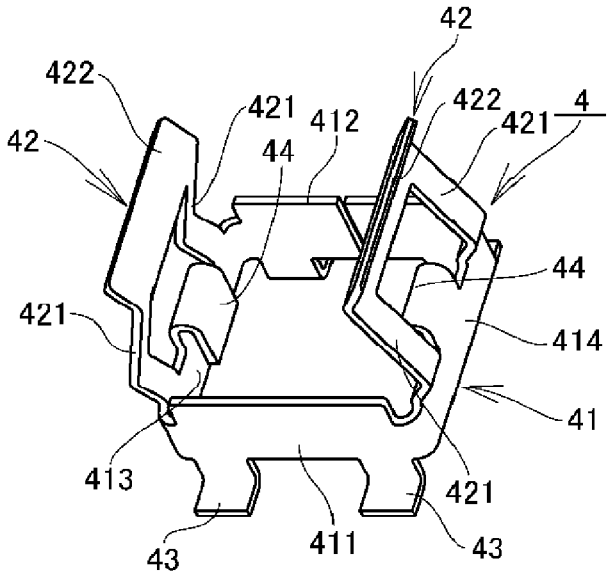
FIG. 5A is a perspective view of an outer contact shown in FIGS. 1A to 1C.
Figure 5B:
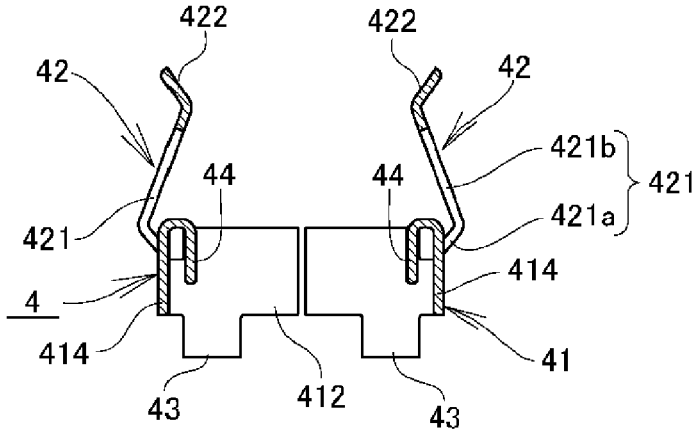
FIG. 5B is a longitudinal cross-sectional view of the same.

As shown in FIGS. 5A and 5B, the outer contact 4 is formed into one unit by pressing an elastic conductive metal plate. The outer contact 4 includes a rectangular tubular portion 41 for covering the outer periphery of the housing base 51, and a pair of elastic contact pieces 42 and 42 that are integrally supported by left and right side plates 413 and 414 of the tubular portion 41, respectively.

The outer contact 4 is integrally provided with board connecting portions 43 and 43 protruding outward from bottom edges of front and back side plates 411 and 412, and integrally provided with fixing engaging portions 44 folded inward at top edges of the left and right side plates 413 and 414. The fixing engaging portions 44 are engaged with the left and right side walls 513 and 514 of the housing base 51 and the board connecting portions 43 and 43 are soldered to traces of the mounting board, so that the housing base 51 is fixed on the mounting board being the support, and the outer contact 4 is electrically connected to the mounting board.

Each of the elastic contact pieces 42 and 42 has a pair of elastic support pieces 421 and 421 the bottom ends of which are integrally supported by the top edge of each of the left and right side plates 413 and 414, and a contact piece 422 extending across both the elastic support pieces 421 and 421. The contact piece 422 and the elastic support pieces 421 and 421 make a gate shape when viewed from the side.

Each of the elastic support pieces 421 and 421 includes a spring base 421*a* extending obliquely outward from the top edge of each of the left and right side plates 413 and 414, and a support spring 421*b* extending obliquely inward from a tip end of the spring base 421*a*. An end of the contact piece 422 is integrally supported by a tip end of the support spring 421*b*.

The contact piece 422 is formed so as to be bent in the shape of a letter V turned left or right. The crest of the bent portion contacts the outer periphery of the mating outer contact 22.

Figure 6A:
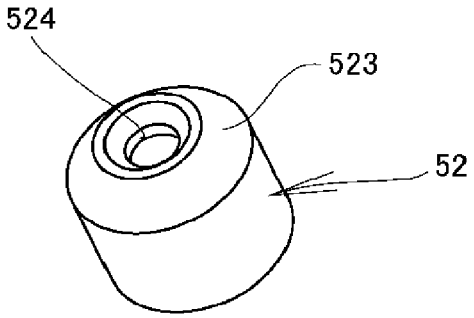
FIG. 6A is a perspective view of a housing movable portion shown in FIGS. 1A to 1C.
Figure 6B:
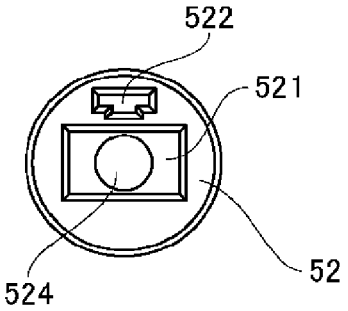
FIG. 6B is a bottom view of the same.
Figure 6C:
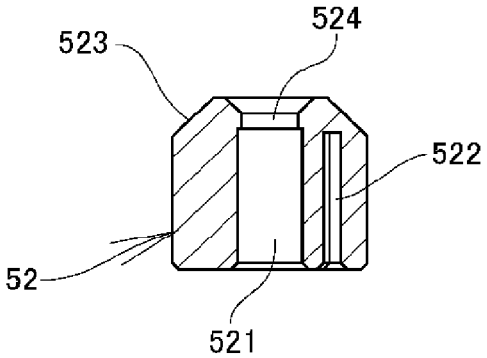
FIG. 6C is a longitudinal cross-sectional view of the same.

As shown in FIGS. 6A to 6C, the housing movable portion 52 is made of an insulating synthetic resin into the shape of a cylinder. The housing movable portion 52 has a rectangular hollow-shaped contact container 521 that is open in a bottom surface.

The housing movable portion 52 is formed with a fixing portion press-fitted slot 522 that is open in the bottom surface and situated outside the contact container 521. Attaching the housing movable portion 52 from the side of a top surface of the housing base 51, a top end portion of the floating fixing portion 62 protruding from a top end of the housing base 51 is press-fitted into the fixing portion press-fitted slot 522, and the connecting portion 32, that is, upper portions of both of the elastic catching pieces 321 and 321 are contained in the contact container 521.

The housing movable portion 52 has a tapered guide slope 523 the diameter of which decreases upward at a top end periphery, and a contact insertion hole 524 that is open to a top end surface and connected to the contact container 521. The pin-like mating center contact 21 is inserted into the housing 5 through the contact insertion hole 524, and fitted into the outside of the housing movable portion 52 by being guided by the tapered guide slope 523.

Note that, the contact insertion hole 524 has a tapered opening edge the diameter of which decreases downward, so as to guide the mating center contact 21 to the center of the hole.

In the coaxial connector 1 with the floating mechanism having the structure described above, the housing movable portion 52 is supported by the housing base 51 through the floating spring 6 in a movable manner, and moves together with the center contact 3. Thus, when mutually connecting the coaxial connectors, even if an axial deviation occurs with respect to the mating coaxial connector 2 in any of the front-back and lateral directions, the axial deviation is automatically adjusted and thus a stable connection state can be achieved.

Figure 7A:
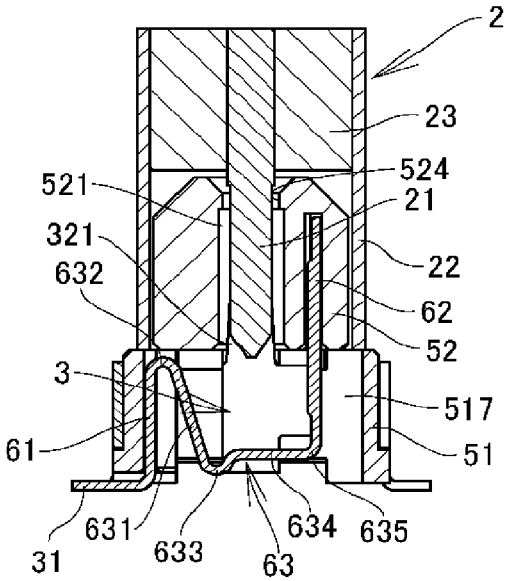
FIG. 7A is a cross-sectional view taken along line A-A in FIG. 1B, in a state of being connected to a mating coaxial connector without any axial deviation.
Figure 7B:
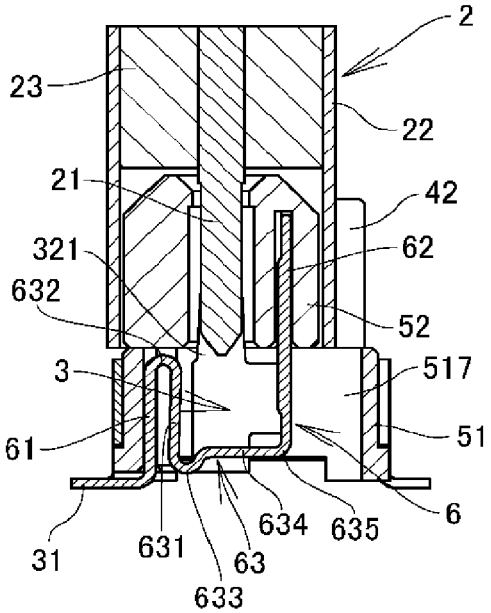
FIG. 7B is a cross-sectional view of the same in a state of being connected to a mating coaxial connector with an axial deviation in a front-back direction.

For example, when mutually connecting to the coaxial connectors 1 and 2, if an axial deviation occurs in the front-back direction, as shown in FIG. 7B, the housing movable portion 52 and the mating coaxial connector 2 are mutually fitted by being guided by the guide slope 523 of the housing movable portion 52. The elastically expandable and contractible portion 631 of the swing spring portion 63 sags and contracts in the front-back direction to allow a front-back movement of a contact portion between the housing movable portion 52 and the center contact 3 with respect to the housing base 51, and thus the center contact 3 is connected to the mating center contact 21.

At this time, the mating outer contact 22 moves in the front-back direction in the state of being fitted onto the outside of the housing movable portion 52 and caught between both of the elastic contact pieces 42 and 42, and thus keeps a stable connection state to the outer contact 4.

When detaching the mating coaxial connector 2, the sagging elastically expandable and contractible portion 631 returns elastically, so that the housing movable portion 52 returns to a center position on the housing base 51 in conjunction with a return of the swing spring portion 63.

Figure 8A:
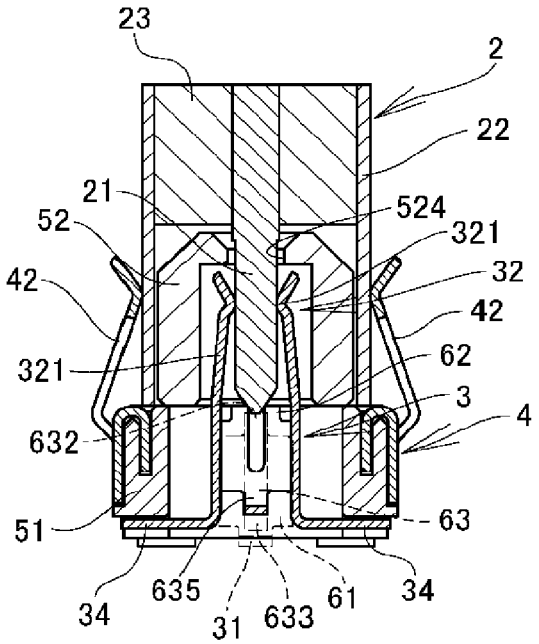
FIG. 8A is a cross-sectional view taken along line B-B in FIG. 1A in a state of being connected to a mating coaxial connector without any axial deviation.
Figure 8B:
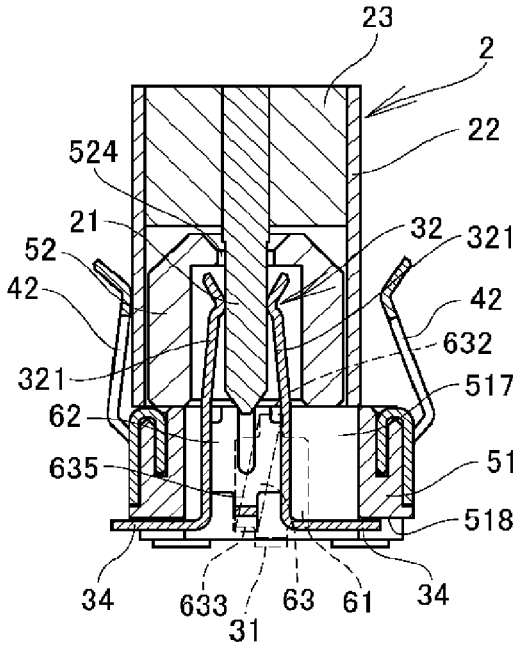
FIG. 8B is a cross-sectional view of the same in a state of being connected to a mating coaxial connector with an axial deviation in a lateral direction.

When mutually connecting to the mating coaxial connector 2, if an axial deviation occurs in the lateral direction, as shown in FIG. 8B, the housing movable portion 52 and the mating coaxial connector 2 are mutually fitted by being guided by the guide slope 523 of the housing movable portion 52. Each elastically twistable portion of the swing spring portion 63 twists about a front-back axis to allow a lateral movement of the contact portion between the housing movable portion 52 and the center contact 3 with respect to the housing base 51, and thus the center contact 3 is connected to the mating center contact 21.

At this time, the mating outer contact 22 is pressed against one of the elastic contact pieces 42 and 42 in the state of being fitted onto the outside of the housing movable portion 52, and thus has a stable connection state to the outer contact 4.

When detaching the mating coaxial connector 2, the sagging elastically expandable and contractible portion 631 returns elastically, so that the housing movable portion 52 returns to the center position on the housing base 51 in conjunction with a return of the swing spring portion 63.

As described above, the front-back and lateral axial deviations can be allowed compositively, such that the elastically expandable and contractible portion 631 allows a movement in the front-back direction and the elastically twistable portions 632 and 635 allow a movement in the lateral direction. Therefore, floating can be performed in any direction.

Moreover, with the use of the integral spring 7, the floating fixing portion 62 integrally supports the contact portion of the center contact 3, and the center position of the center contact 3 moves following the center position of the mating center contact 21 with a floating operation. Therefore, it is possible to prevent a deviation of a central axis in the connector and hence deterioration in high-frequency performance.

Note that, the coaxial connector 1 with the floating mechanism is applied to the socket in the above embodiment, but may be applied to a plug.

In the above embodiment, the support for supporting the housing 5 is the mounting board installed in an electronic component, but the support is not limited to this. For example, the support may be an electronic equipment case. Or alternatively, the coaxial connector may be connected to a coaxial cable and the coaxial cable may serve as the support.

Also, the coaxial connector 1 with the floating mechanism according to the present invention may be applied to a multiple connected coaxial connector in which a plurality of housing movable portions 52 are joined in a movable manner on the housing base 51.

REFERENCE SIGNS LIST

1 coaxial connector with a floating mechanism
2 mating coaxial connector
21 mating center contact
22 mating outer contact
23 insulator
3 center contact
31 circuit board connection terminal piece
32 connecting portion
321 elastic catching piece
322 contact point
33 support piece
34 retained guide piece
4 outer contact
41 tubular portion
42 elastic contact piece
421 elastic support piece
422 contact piece
43 board connecting portion
44 fixing engaging portion
5 housing
51 housing base
511 to 514 side wall
515 support fixing portion press-fitted portion
516 avoidance groove
517 inner hollow portion
518 guide slot
52 housing movable portion
521 contact container
522 fixing portion press-fitted slot
523 guide slope
524 contact insertion hole
6 floating spring
61 support fixing portion
62 floating fixing portion
621 expanded portion
63 swing spring portion

631 elastically expandable and contractible portion
632 bent portion (elastically twistable portion)
633 bent portion
634 impedance adjusting portion
635 bent portion (elastically twistable portion)
7 contact-equipped floating spring (integral spring)

The invention claimed is:

1. A coaxial connector with a floating mechanism, the coaxial connector comprising:

a center contact to be mutually connected to a mating center contact;

an outer contact disposed outside the center contact; and a housing for keeping the center contact and the outer contact insulated from each other, wherein the housing includes a housing base fixed to a support, a housing movable portion that is movable together with the center contact relative to the housing base, and a floating spring one end of which is fixed to the housing base and the other end of which is fixed to the housing movable portion, the floating spring includes a support fixing portion fixed to the housing base, a floating fixing portion fixed to the housing movable portion, and an elastically deformable swing spring portion for coupling the support fixing portion and the floating fixing portion, the housing movable portion is supported by the housing base through the floating spring in a movable manner, and the swing spring portion integrally includes:

an elastically expandable and contractible portion that is expandable and contractible in a direction between the support fixing portion and the floating fixing portion, and an elastically twistable portion that is twistable about an axis in the direction between the support fixing portion and the floating fixing portion.

2. The coaxial connector with a floating mechanism according to claim 1, wherein:

the center contact includes a contact portion that moves together with the housing movable portion, and a circuit board connection terminal to be connected to a mounting board;

the contact portion is integrally supported by the floating fixing portion;

the circuit board connection terminal is integrally supported by a support portion; and the center contact and the floating spring are integrated into one unit.

3. The coaxial connector with a floating mechanism according to claim 2, wherein:

the floating spring includes, at the swing spring portion, an impedance adjusting portion a width of a plate of which is changeable; and the width of the impedance adjusting portion is appropriately changed such that the center contact has an appropriate impedance.

4. The coaxial connector with a floating mechanism according to claim 1, wherein a plurality of housing movable portions are supported in a movable manner by the housing base.

5. A coaxial connector with a floating mechanism, the coaxial connector comprising:

a center contact to be mutually connected to a mating center contact;

an outer contact disposed outside the center contact; and a housing for keeping the center contact and the outer contact insulated from each other, wherein the housing includes a housing base fixed to a support, a housing movable portion that is movable together with the center contact relative to the housing base, and a floating spring one end of which is fixed to the housing base and the other end of which is fixed to the housing movable portion, the floating spring includes a support fixing portion fixed to the housing base, a floating fixing portion fixed to the housing movable portion, and an elastically deformable swing spring portion for coupling the support fixing portion and the floating fixing portion, the housing movable portion is supported by the housing base through the floating spring in a movable manner, and the outer contact includes, outside the housing movable portion, a pair of elastic contact pieces that are opposite to each other with a gap in a direction orthogonal to the direction between the support fixing portion and the floating fixing portion.

6. The coaxial connector with a floating mechanism according to claim 5, wherein:

the center contact includes a contact portion that moves together with the housing movable portion, and a circuit board connection terminal to be connected to a mounting board;

the contact portion is integrally supported by the floating fixing portion;

the circuit board connection terminal is integrally supported by a support portion; and the center contact and the floating spring are integrated into one unit.

7. The coaxial connector with a floating mechanism according to claim 6, wherein:

the floating spring includes, at the swing spring portion, an impedance adjusting portion a width of a plate of which is changeable; and the width of the impedance adjusting portion is appropriately changed such that the center contact has an appropriate impedance.

8. The coaxial connector with a floating mechanism according to claim 5, wherein a plurality of housing movable portions are supported in a movable manner by the housing base.

* * * * *